US008506877B2

(12) United States Patent
Borrel

(10) Patent No.: US 8,506,877 B2
(45) Date of Patent: Aug. 13, 2013

(54) METHOD AND DEVICE FOR ADJUSTING THE COOLING AND ENERGY RECOVERY OF A STEEL STRIP IN AN ANNEALING OR GALVANIZATION PHASE

(75) Inventor: Pierre-Jérôme Borrel, Saint Chamond (FR)

(73) Assignee: Siemens VAI Metals Technologies SAS, Saint Chamond (FR)

( * ) Notice: Subject to any disclaimer, the term of this patent is extended or adjusted under 35 U.S.C. 154(b) by 255 days.

(21) Appl. No.: 13/056,691

(22) PCT Filed: Jul. 29, 2008

(86) PCT No.: PCT/FR2008/001132

§ 371 (c)(1),
(2), (4) Date: Mar. 21, 2011

(87) PCT Pub. No.: WO2010/012869

PCT Pub. Date: Feb. 4, 2010

(65) Prior Publication Data

US 2011/0186282 A1 Aug. 4, 2011

(51) Int. Cl.
*F28F 7/00* (2006.01)

(52) U.S. Cl.
USPC ..... 266/46; 266/113; 266/114

(58) Field of Classification Search
USPC ..... 266/113, 114, 90, 241, 46
See application file for complete search history.

(56) References Cited

U.S. PATENT DOCUMENTS 4,252,572 A * 2/1981 Schaming ..... 266/113
4,371,149 A * 2/1983 Takeuchi et al. ..... 266/90
4,425,928 A * 1/1984 Greenberger et al. ..... 266/113
4,625,431 A 12/1986 Nanba et al.
7,381,364 B2 6/2008 Yamashita

FOREIGN PATENT DOCUMENTS

EP 0182050 A2 5/1986
EP 0418166 A1 3/1991
EP 1602738 A1 12/2005
JP 2000119757 A 4/2000
JP 2005179774 A 7/2005

OTHER PUBLICATIONS

Dr.-Ing. Th. Messing: "Dampfstrahlverdichter als Wärmepumpen", Chemie Ingenieur Technik, XP002523826, 1958, p. 592, col. 2, paragraph 7, p. 593, col. 1, paragraph 2; figures 9, 10, Duisberg, Germany. Statement of Relevance attached.

* cited by examiner

*Primary Examiner* — Scott Kastler
(74) *Attorney, Agent, or Firm* — Laurence A. Greenberg; Werner H. Stemer; Ralph E. Locher

(57) ABSTRACT

A method and a device adjust the cooling of a steel strip in an annealing or galvanization phase. The device is suitable for the forced cooling of a steel strip continuously running in a plant adapted for the continuous annealing or the continuous tempering galvanization. The device has at least one exchange member for transferring the heat of the steel strip to cooling water and includes an outlet for the cooling water thus heated up. At least one cooling unit is provided and has a sealed enclosure connected to the outlet of the exchange member and includes at least one outlet to a Venturi effect device such as a vapor outlet ejector and in which the cooling water itself is subjected to a vacuum-vaporization cooling. An auxiliary outlet of the sealed enclosure is connected to an inlet of the exchange member.

21 Claims, 8 Drawing Sheets

METHOD AND DEVICE FOR ADJUSTING THE COOLING AND ENERGY RECOVERY OF A STEEL STRIP IN AN ANNEALING OR GALVANIZATION PHASE

BACKGROUND OF THE INVENTION

Field of the Invention

Method and device for adjusting the cooling of a steel strip in an annealing or galvanization phase.

The present invention relates to a method and a device for adjusting the cooling needed for forced cooling of a steel strip running continuously in a plant adapted for continuous annealing or continuous hot-dip galvanization.

In particular, the invention relates to continuous annealing furnaces intended to provide for heat treatment of cold-rolled steel strips, particularly for the rapid cooling of said strips.

Cold-rolling of steel causes hardening of the steel by cold working, which gives rise to fragility, making the subsequent shaping of cold-rolled strips problematic or impossible.

In order to restore the ductility of such strips, heat treatment known as "recrystallization annealing" is used. To do this, as an alternative to static treatments in bell furnaces (batch annealing) applied to reels of cold-rolled strips, specialized (annealing) lines have been designed to undertake the treatment of such strips when running continuously.

As an example, a diagram of such a continuous annealing line is shown in FIG. 1 and typically comprises:

- an input section comprising one or two strip payout reels (1), a guillotine shear (2), a butt welder (3) for connecting the tail of one strip emerging from one of the payout reels to the head of the next strip emerging from the other payout reel, thus ensuring continuous operation of the line, a strip consolidator (4) downstream, which reconstitutes the strip previously consolidated when the payout upstream of the consolidator is stopped to carry out the butt welding;
- a furnace (5) with a preheating section (6), a section maintaining the annealing temperature (7), a rapid cooling section (8), a section with several overaging units (9) followed by a cooling section under a protective gas (10);
- an output section with an output consolidator (11), a strip cold-rolling assembly of the "Skin-Pass" type (12), a shear (13) and one or two strip take-up reels (14) operating alternately.

The furnace must be capable of providing, for strip running speeds of several hundred meters per minute, heating and cooling rates and maintenance times matched to the metallurgy of the steel being treated. While the heating and maintenance time essentially involve the length of the furnaces and thus the investment costs, the cooling rate poses real technological problems.

There are five known types of cooling methods which can be used, depending on the required rate:

- methods using water- or air-cooled tubes, which, acting conversely to radiant heating tubes, absorb radiation from the strip. They only allow low cooling rates of the order of 2 to 10° C./s and are hardly used except in the initial phase of cooling, for example between 800 and 600° C. They are therefore unsuitable for high tempering rates;
- cooling methods using neutral gas jets on the strip, such as nitrogen or a reducing mixture of nitrogen and hydrogen, the percentage of which is close to or slightly over 5% (also known as "Gas Jet Cooling"). They allow cooling rates of 10 to 150° C./s depending on the gas flow rates and temperatures, the running speed and the thickness of the strips. They have the advantage of not oxidizing the surface of the strips and even of reducing the surface oxides, which might have formed upstream in the furnace. However, they allow cooling rates which are too slow for certain steels. Such plants are described, for example, in documents EP 1 602 738 and EP 0 182 050;
- strip cooling methods on rollers (also known as "Roll Quenching"), which provide cooling rates a little higher than those obtained by means of gas jets. These methods are based on an exchange between the surface of the strip and the surface of interlaced rollers cooled by circulation of water around which the strip snakes. Able to be carried out in a neutral or slightly reducing atmosphere, they have the same advantages as gas jets but also certain disadvantages of strip flexing, particularly for broad and fine strips. Furthermore, the efficiency of the heat exchange by conduction decreases with an increase in the thickness of the strip. Such plants are described, for example, in document EP 0 418 166;
- cooling methods using atomization of water or air/water mists allowing cooling rates clearly more rapid which might reach several hundred degrees per second, typically, depending on the density of the mist, between 50 and 400° C./s. It is then possible to treat high-tensile steels, for example with an entirely or partially martensitic final structure. However, they have the disadvantage of oxidizing the surface of the strip and requiring pickling at the outlet from the furnace. Such plants are described, for example, in document JP 2000 119757;
- methods using direct strip quenching in a tank of water (also known as "Water Quenching") at a controlled temperature close to 50° C. allowing cooling rates which might reach several thousand degrees per second, typically between 1000 and 4000° C./s. They have multiple disadvantages, such as cooling the strip to temperatures which are too low to ensure overaging without reheating, oxidizing the strip and producing vapor, which complicates control of the furnace atmosphere. They require heating up to 350° C. before overaging and pickling at the outlet from the furnace. Such plants are described, for example, in document JP2005179774.

All these methods have the common denominator of extracting heat from the strip and returning it outside the furnace by means of a cooling medium, water in the most general case. Methods using this water directly (such as quenching tanks) or indirectly by means of exchanger systems (such as gas jets) are supplied with water at or close to ambient temperature, typically 30 or 35° C. and return water with a temperature generally not reaching more than 40 to 70° C. It is clearly difficult to envisage applications for this water heated to a relatively modest temperature except, possibly, for heating buildings. Even if it is theoretically possible to make the use and distribution of heat thus recovered easier by tolerating a higher cooling water temperature, such an increase in temperature could only be to the detriment of the efficiency of the process of cooling the strip, which is clearly not desirable.

More usually, the water is treated in accordance with evaporative cooling methods such as cooling towers or air-to-air cooling devices. Since the temperature of the water thus cooled remains higher than the wet-bulb temperature of the ambient air and is more subject to climatic variations, the efficiency of these cooling methods is limited to minimum temperatures of about 30 to 35° C.

In view of the constant increase in the price of energy and the impact of its generation on the environment, it is more and more necessary to recover and use with the greatest efficiency on the site itself where it can be collected, the energy available in cooling processes, which are numerous in the metallurgical industry.

BRIEF SUMMARY OF THE INVENTION

An object of the present invention is therefore to propose a cooling adjustment method and a device to implement it, both being adapted for forced cooling of a steel strip running continuously in a plant adapted for continuous annealing or continuous hot-dip galvanization, allowing an advantageous cooling dynamic for any type of strip under various annealing or galvanization conditions.

In particular, the method and device according to the invention should have several advantages with respect to the existing methods or devices, in that:

- they provide for the efficient recovery of energy given up by cold-rolled steel strips during cooling in the cooling sections of continuous annealing or galvanization furnaces and the immediate reuse of this energy with a maximum of efficiency;
- they make it possible to lower the temperature of the cooling water to values below 10°;
- they allow an increase in the cooling rate in the methods used under a neutral or reducing atmosphere, thus not requiring subsequent pickling;
- they can also be implemented, in the field of the metallurgical industry, anywhere where the recovery of cooling water is involved, for example that used in cooled rollers and walls in continuous steel casting or in the cooled walls and roofs of electric fusion furnaces.

Examples of embodiment and application to clarify and assist with the proper interpretation of the invention are provided with the aid of the following figures:

DESCRIPTION OF THE INVENTION

Figure 1:
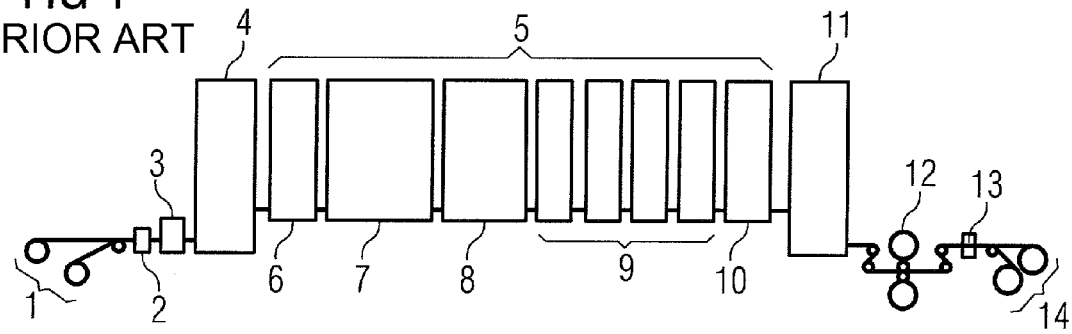
FIG 1 PRIOR ART
FIG. 1 is a diagram of a continuous annealing line according to the prior art.
Figure 2A:
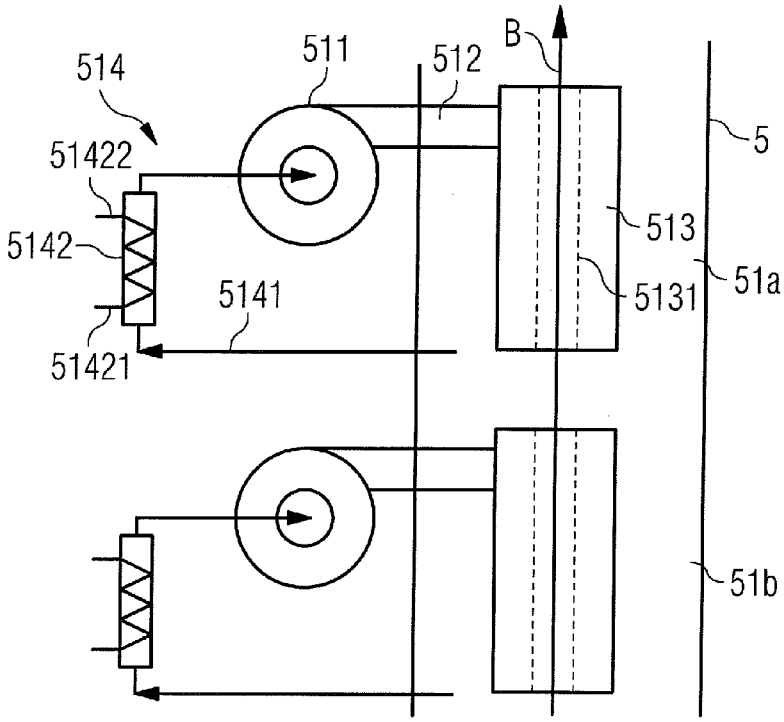
FIGS. 2*a*, 2*b*, 2*c*: Diagrams associated with different modes of rapid cooling in a continuous annealing furnace.

FIG. 2*a* gives a schematic description of rapid cooling by gas jet (or blowing) in a continuous annealing furnace: a steel strip (B) runs vertically in a furnace (5), passing through at least one blowing cell (51). Each cell (51) has a motor-fan set (511) supplying a blowing box (513) by means of a duct (512). Each blowing box (513) encircles the strip and each of its two faces parallel to the strip is fitted with cool gas diffusers (5131). The gas heated in contact with the strip is cooled in at least one cooling unit (514), each of which includes a duct (5141) providing for collection of the hot gas in the furnace enclosure to direct it into an exchange device comprising a gas/water exchanger (5142). Circulation of cold water between the inlets and outlets (51421, 51422) lowers the temperature of the gas, which, thus cooled, returns to the inlet of motor-fan (511).

Figure 2B:
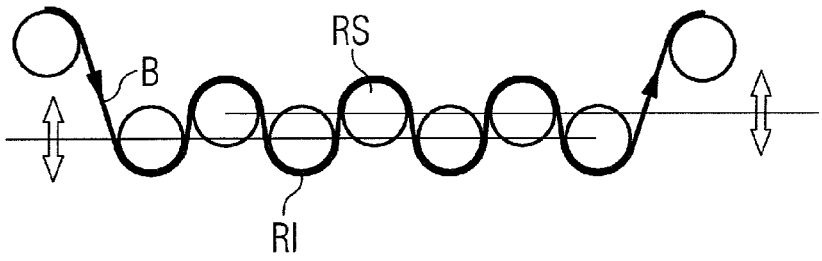

FIG. 2*b* gives a schematic description of rapid cooling by cooled rollers: the steel strip (B) snakes between a lower layer (RI) and an upper layer (RS) of several rollers arranged side by side and with main axes parallel, said rollers being cooled by circulation of water under low pressure. At least one of the two layers is capable of moving vertically in order to adjust the interlacing of the rollers and, consequently, the arc of contact between the strip and the surface of the rollers with a view to adjusting the heat exchange between the two. The larger the arc of contact (owing to a large space between the layers, i.e. an increase in the divergence between the axes of consecutive rollers) the more the cooling is intensified and vice versa to reduce the cooling.

Figure 2C:
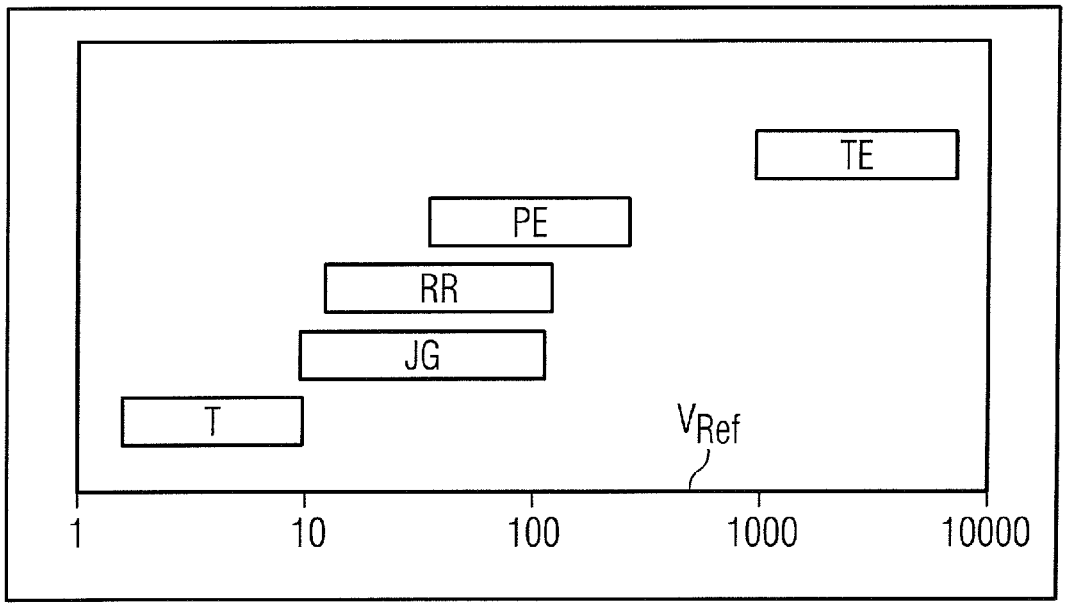

FIG. 2*c* shows a diagram of the range of cooling rates ($V_{Ref}$), between 1 and 10000° C./s, of usual steel strip cooling methods: a method with cooled tubes (T), a gas jet method (JG), a method with cooled rollers (RR), a method with atomization of water or a water/gas mixture (PE) and finally, for the most rapid, a method using quenching in a tank of water (TE). It should be noted that the cooling adjustment according to the invention is advantageously adapted to the dynamic of each of these methods, while providing a solution to the problems raised above.

Figure 3A:
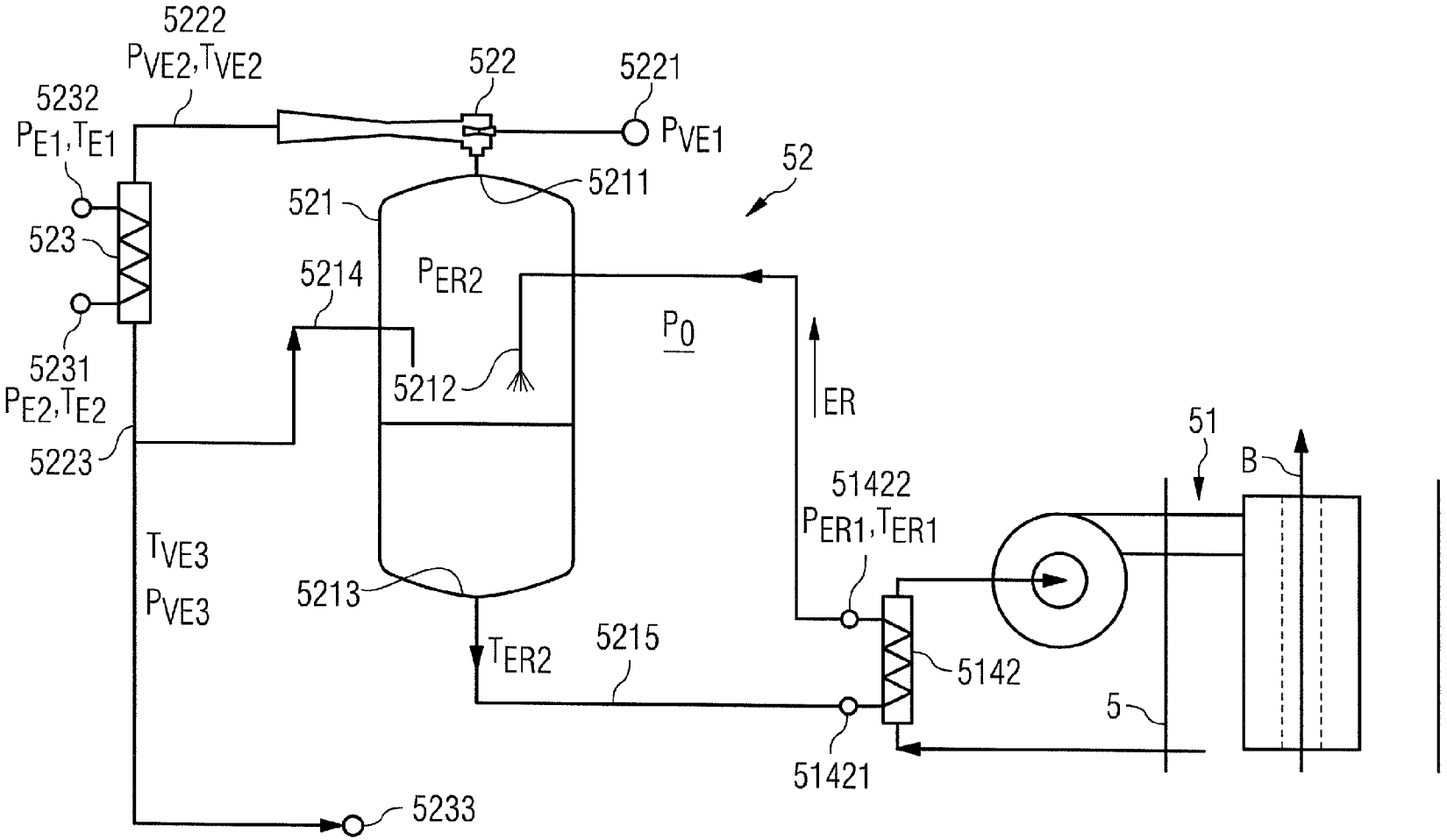
FIG. 3*a*, 3*b*: Schematic diagrams of the device according to the invention.

FIG. 3*a* shows a schematic diagram of the device according to the invention in relation to FIG. 2*a* as an example, where a gas jet (blowing) cooling method involves a cell (51) blowing on the strip (B) running continuously. As described in FIG. 2*a*, the heated gas is recovered in the furnace enclosure (5) and passes into a gas/water heat exchanger (5142), the inlets and outlets of which (51421 and 51422), on the water (to be cooled) side, are connected to a cooling unit in a vacuum (52) linked to said exchanger (5142).

More generally, FIG. 3*a* presents the cooling adjustment device according to the invention needed for forced cooling of a steel strip (B) running continuously in a plant adapted for continuous annealing or continuous hot-dip galvanization, said device comprising:

- at least one exchange unit (51, 5142) providing for a transfer of heat from the steel strip to cooling water and comprising an outlet (51422) for the cooling water thus heated,
- at least one cooling unit (52) comprising a sealed enclosure (521) connected to the outlet (51422) from the exchange unit (5142) and fitted with at least one outlet (5211) on a Venturi effect device such as a vapor ejector (522) and in which the cooling water is itself subjected to cooling by evaporation in a vacuum,
- an auxiliary outlet (5213) from the sealed enclosure (521) connected to an inlet (51421) to the exchange unit (51, 5142).

In this case of cooling by gas jets, the cooling gas is blown by blowing cells comprising a blowing motor-fan in diffusion chambers placed on each side of the strip so as to cool both faces of it. The gas in contact with the strip, which is heated to 45° C.-180° C., is sucked by the fan into the furnace enclosure and passes into an exchange unit made up of a gas/water exchanger, whence it emerges at 30° C.-50° C. before being reinjected by the fan into the diffusion chambers. In general, the cooling is performed by several cells placed one after the other along the path of the strip. This is cooled gradually between the maximum temperature, i.e. 600 to 800° C. and the usual overaging or galvanization temperature, i.e. 300 to 500° C. Advantageously, the device according to the invention may include several cooling units, each comprising a cell or a set of several blowing cells, each unit being able to be sized with a view to staging the temperature of the water returned to the exchange unit, for example from 30 to 10° C. in order to stage the temperature of the strip cooling gases in the direction in which it is running, the highest temperature of returned water being upstream of the cooling section and the lowest temperature downstream, where the difference in temperature between the strip and the cooling gas is lowest.

In a variant of this first cooling method, a first cooling unit linked to a first exchange unit positioned upstream of the fan acts as described above and a second cooling unit linked to a second exchange unit positioned downstream of the fan properly ensures that the gas entering the diffusion chambers is cooled with icy water at a temperature between 5 and 10° C.

The same principles can be applied in a strip cooling plant with cooled rollers in which the contact between the surface of the strip and the surface of the rollers plays the part of exchange unit (51, 5142), being linked to the cooling unit (52). This plant is in particular well adapted for efficient staging of the returned water temperatures.

The exchange unit (51, 5142) between the strip and the cooling water can thus, depending on the type of embodiment, advantageously be a water/water or gas/water exchanger and can be applied to methods of gradual cooling of the strip such as cooling using cooled tubes or gas jets or cooled rollers.

Finally, the cooling adjustment device according to the invention may include at least one vapor condensation unit (523) positioned at the outlet from the ejector (522) on the sealed enclosure and adapted for resupplying the sealed enclosure (521) as a supplement (5214) with a required level of water and, if necessary, adapted for redirecting a surplus of said vaporized water towards an external pipe (5233) for reuse or dissipation of the vapor, ideally for the factory's own needs or vapor discharge.

The cooling device may be of the "barometric" type, i.e. the enclosure placed under partial vacuum is connected to the exchange unit by a water column, generally speaking, at least eleven meters high. This arrangement is particularly well adapted for exchange sources of the quenching tank type, an example of application of the invention for which will be presented below.

It may also be of the closed type, the sealed enclosure placed under partial vacuum being connected to the exchange unit by a closed circuit comprising a circulation pump. This arrangement is particularly adapted for exchange sources of the heat exchanger type.

Figure 4:
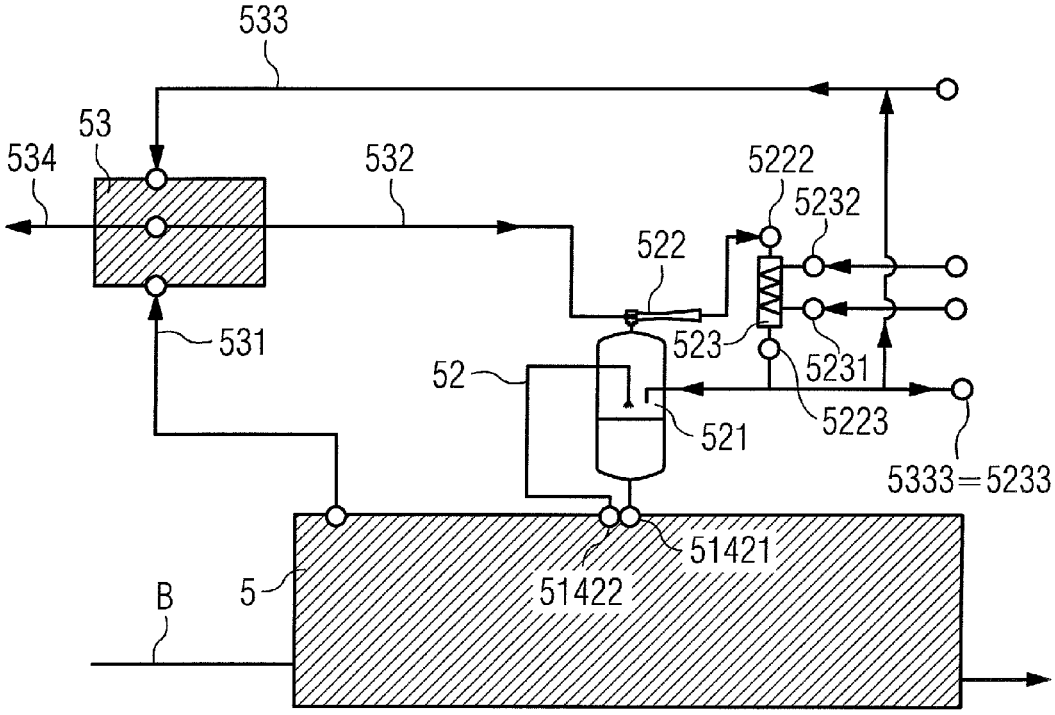
FIG. 4: General diagram of the circulation of the fluids in relation to the device according to the invention in a continuous annealing plant.

Particularly advantageously, the vapor supplying the ejector comes from a vapor production boiler heated with flue gases in the direct-flame heating part of the furnace or with fumes coming from radiant tubes (see the example according to FIG. 4). In furnaces with traditional burners, the quantity of vapor thus produced is sufficient to meet the needs of both the ejector and a strip degreasing section. In the case of burners known as "regenerative", the increase in combustion efficiency reduces the quantity of flue gases and the vapor production capacity may be found to be insufficient to cover the degreasing needs but remains sufficient to supply the ejectors.

Thus, condensation heat of the vapor emerging from the ejector and heat recovered in the cooling water can easily be recovered in the condensation unit (523) supplying hot water at a high temperature close to evaporation temperature at a given pressure.

The condensation unit for the vapor coming from the ejector may be an exchanger, the vapor exchange circuit of which is supplied with more or less hot water at low pressure recovered in the plant, for example originating from a degreasing section, and heated in the exchanger to a temperature equal to or slightly below the evaporation temperature at the pressure in question.

It may also comprise a direct-contact exchanger providing for direct exchange between the vapor coming from the ejector and the cooling water to be heated and globally return water at a temperature slightly below the evaporation temperature at a given pressure.

Advantageously, part of the water emerging from the condensation unit at a temperature ($T_{VE3}$) can be used, possibly after cooling, as demineralized water in a continuous annealing or galvanization plant. For example, for high-pressure cleaning of the cylinders of a "skin-pass" rolling mill or for compensating for losses of demineralized water by evaporation or by being taken by the strip into the degreasing/rinsing tanks.

Said device according to the invention is thus advantageously adapted for the implementation of a cooling adjustment method needed for forced cooling of a steel strip (B) running continuously in a plant adapted for continuous annealing or continuous hot-dip galvanization, characterized in that cooling energy is given up to the heated water (ER) by the steel strip and then removed by evaporation of said heated water (ER) at a pressure ($P_{ER2}$) below atmospheric pressure ($P_0$) and finally returned by condensation at a higher temperature ($T_{VE2}$) following thermomechanical compression by a venturi type device supplied with vapor at a pressure ($P_{VE1}$) higher than atmospheric pressure ($P_0$) and comprising the following stages:

- the water heated (ER) by the strip is collected in an exchange unit (5142) at a first pressure ($P_{ER1}$) close to atmospheric pressure ($P_0$) and a first temperature ($T_{ER1}$) appreciably lower than the evaporation temperature of the water at pressure ($P_{ER1}$),
- the heated water (ER) from the exchange unit (5142) is introduced in the form of a jet into a sealed enclosure (521) fitted with at least one ejector (522) as a venturi type device, said ejector also being supplied with water vapor (5221) at an incoming pressure ($P_{VE1}$) higher than atmospheric pressure (P),
- the ejector provides a partial vacuum in the sealed enclosure (521) corresponding to a second pressure ($P_{ER2}$) lower than an evaporation pressure of the water at the first temperature ($T_{ER1}$).
- cooled water is recovered at an outlet (5213) from the sealed enclosure (521) at a second temperature ($T_{ER2}$) corresponding to an evaporation temperature of the water at the second pressure ($P_{ER1}$) to be returned to the exchange unit (5142).

Ideally (but not mandatorily), the method provides that an additional cooling circuit can be used at the outlet from the ejector, wherein:

- a vapor emerging from the ejector (522) and with a thermal energy associated with a decreasing kinetic energy and increased by the fraction of heat originating from the cooling water obtained by evaporation is obtained at an output pressure ($P_{VE2}$) from the ejector higher than atmospheric pressure ($P_0$),
- said vapor emerges from the ejector at an output temperature ($T_{VE2}$) corresponding to an evaporation pressure for the water at the output pressure ($P_{VE2}$) and supplies a condensation unit (523) from which it emerges again at a post-condensation temperature ($T_{VE3}$) lower than the output temperature ($T_{VE2}$) from the ejector and under an evaporation pressure for the water at a pressure ($P_{VE3}$) close to atmospheric pressure ($P_0$), the condensation unit (523) provides, through a wall (=free from direct contact), for the heating of an external water circuit (5231, 5232) at an external input pressure ($P_{E1}$) from an external input temperature ($T_{E1}$) lower than an evaporation output temperature ($T_{E2}$) at the external input pressure ($P_{E1}$) to said external output temperature ($T_{E2}$) corresponding to an evaporation temperature for the water at an external output pressure ($P_{E2}$) almost equal to the external input pressure ($P_{E1}$), except for losses of loading.

Alternatively, an additional cooling circuit is used at the outlet from the ejector, wherein:

a vapor emerging from the ejector (522) and with a thermal energy associated with a decreasing kinetic energy and increased by the fraction of heat originating from the cooling water obtained by evaporation is obtained at an output pressure ($P_{VE2}$) higher than atmospheric pressure ($P_0$), said vapor emerges from the ejector at an output temperature ($T_{VE2}$) corresponding to an evaporation pressure for the water at the output pressure ($P_{VE2}$) and is brought into direct contact in a direct-contact (thermal) water exchanger, said water being at an external input pressure ($P_{E1}$) from an external input temperature ($T_{E1}$) lower than an output temperature ($T_{E2}$) to said output temperature ($T_{E2}$) of the mixture of the two vapor-water fluids capable of reaching the evaporation temperature of the water at the external input pressure ($P_{E1}$).

Advantageously, the method according to the invention provides that the water emerging from the condensation unit (523) at the post-condensation temperature ($T_{VE3}$) is reintroduced as a supplement into the sealed enclosure (521) through a duct (5214) and, if necessary, a surplus of said water is redirected towards an external pipe (5233) for vapor reuse (if the condensation unit is a direct-contact exchanger) or dissipation (if the condensation unit is a wall exchanger). Cooling is thus efficiently effected in a loop with dynamic heat circulation/transfer and also presents a possibility of supplying an excess of residual heat or energy to other applications requiring it.

Finally, at the outlet from the cooling unit, the cooled water recovered at the outlet (5213) from the sealed enclosure (521) is water known as icy at the second temperature ($T_{ER2}$) between 5 and 10° C. This is simply taken back to the inlet (51421) to the exchange unit (5142), for example via a duct (5215), with a view to efficiently cooling the flow of gas circulation as part of cooling the strip by blowing.

To sum up, the invention according to FIG. 3*a* (and the subsequent figures) as regards the method and the device for implementation of it thus very advantageously provides for dynamic recovery of energy stored by the water used for the forced cooling of a continuously running steel strip, this water being in fact reused for the purpose of cooling the exchange unit (51, 5142).

In other words and more precisely, the method according to the invention and the device for implementation of it present several advantages with respect to the existing methods:

They provide for efficient recovery of the energy given up by the cold-rolled steel strips during cooling of them in the cooling sections of continuous annealing or galvanization furnaces and its immediate reuse with a maximum of efficiency. It should be noted here that the range of energy in question is over a megawatt. The energy recoveries are therefore major and, among other things, provide for cooling loop redistribution or for supplying at least part of this energy recovered to other points of consumption, such as in the factory itself. Protection of the environment is therefore considerably increased.

They allow the temperature of the cooling water to be reduced to values below 10° C.

They allow for an increase in the cooling rate for the methods used under a neutral or reducing atmosphere and not requiring subsequent pickling.

They can also be implemented, in the field of the metallurgical industry, wherever the recovery of cooling water is involved, for example that used in cooled rollers and walls for continuous steel casting or in the cooled walls and roofs of electric fusion furnaces.

Figure 3B:
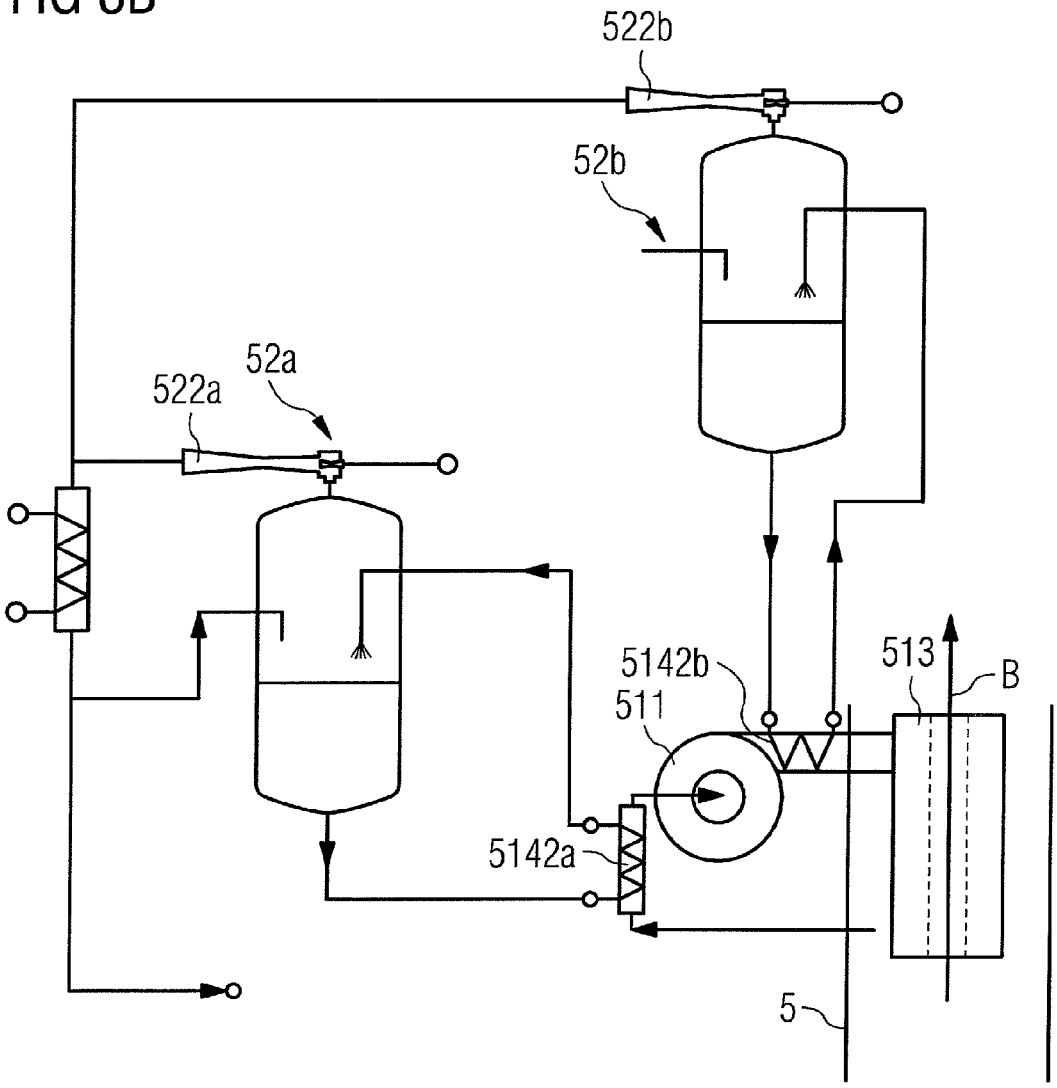

As regards the device, multiple embodiment advantages are possible and thus appropriate to a cooling device for any type of current annealing or galvanization plant and de facto for any type of strip, in that:

part to all of the water emerging from the condensation unit (523) can be re-injected, following possible re-cooling, into a circuit of demineralized water which can be used by the continuous annealing or galvanization plant. The water emerging from the condensation unit is thus advantageously reintroduced, for one part, as a supplement into the sealed enclosure (521) through the duct (5214) and, for the residual part and if necessary, into a vapor production unit in the factory via the duct (5233);

the vapor condensation unit (523) actuating the ejector may be a single wall exchanger;

the vapor condensation unit (523) actuating the ejector may alternatively be a single direct-contact exchanger;

the exchange unit (51) between the steel strip and the cooling water may be a single gas/water exchanger;

a water circulation circuit comprising a collection duct (5212) and a return duct (5215) ideally constituting a water column at least eleven meters high can be placed between the sealed enclosure (521) and the exchange unit (51, 5142);

a water circulation circuit comprising a closed circuit including at least one circulation pump can be positioned between the sealed enclosure (521) and the exchange unit (51, 5142) to facilitate water transfers (for example in the event of a need for pumping up);

FIG. 3*b* describes a variant of the device according to FIG. 3*a* in which a first cooling unit (52*a*) is connected to a first exchange unit (5142*a*) positioned upstream of the fan (511) and supplied with water cooled to 30° C. and a second cooling unit (52*b*) is connected to a second exchange unit (5142*b*) positioned between the fan (511) and the blowing box (513) and supplied with icy water at a temperature below or equal to 10° C. The cooling can thus be even more efficiently accentuated while having the same energy recovery properties and other advantages associated with the device according to FIG. 3*a*.

In other words and more generally, the exchange unit (51) may include at least two heat exchangers (5142*a*, 5142*b*) arranged in series on a heat exchange path between the steel strip and the cooling water, each of the exchangers being connected to one of two cooling units (51*a*, 51*b*), the two outlets from the ejectors (522*a*, 522*b*) on these cooling units being coupled in parallel.

In the case of a single blowing unit, the device provides, for example, that:

the exchange unit (51) comprises at least one fan (511) supplying, through an air duct (512), a blowing box (513) through which the steel strip passes and which is supplied by an air duct (5141) collecting the hot air in the box (513), each of the air ducts (512, 513) is coupled to one of the two heat exchangers (5142*a*, 5142*b*).

FIG. 4 describes, as an example and in relation to FIGS. 3*a* and 3*b*, a general diagram of the circulation of fluids concerned by a cooling adjustment device according to the invention in a continuous strip (B) annealing plant. The annealing furnace (5) is fitted with a water cooling unit (52) connected to a rapid strip cooling unit according to one of the methods described above and mentioned in FIG. 2*c*. The device according to the invention also includes a vapor production unit (53) obtained by heating by means of fumes collected at the strip entry into the furnace in the preheating zone through a duct (531) for collecting fumes to be taken to a boiler (53). The vapor thus produced in the boiler supplies the ejector (522) on the cooling unit (52) through the duct (532). As described in FIGS. 3*a* and 3*b*, the water heated by the heat of the strip is collected at a suction aperture (51422), cooled in the sealed enclosure (521) and returned to a discharge aperture (51421). The vapor emerging from the ejector (522) is, for its part, taken to the condenser (523) whence it emerges into (5223) in the form of hot water, which returns, for one part, into the enclosure (521) as a supplement, to the duct (533) returning condensates to the boiler (53) and to an outlet (5333=5233 according to FIG. 3*a*) capable of supplying certain processing line devices with demineralized water, for example a "skin-pass" type strip rolling mill or strip degreasing/rinsing tanks. The condenser (523) receives water in (5231) and discharges heated water into (5232). On this figure, the required pump and valve accessories are not shown for reasons of clarity.

To sum up, the ejector includes an auxiliary inlet (5221) in addition to its other inlet at the outlet (5211) from the sealed enclosure (521) through which the ejector is efficiently supplied by at least part to all of the vapor required by means of a vapor production boiler (53) heated with flue gases (531) in a direct-flame heating part of the furnace or by radiant-tube section fumes.

In this example of an embodiment, the recovery of flue gases or fumes, usually unused, provides here for reuse for the purpose of loop cooling, hence a considerable energy gain and consequent energy savings.

Figure 5:
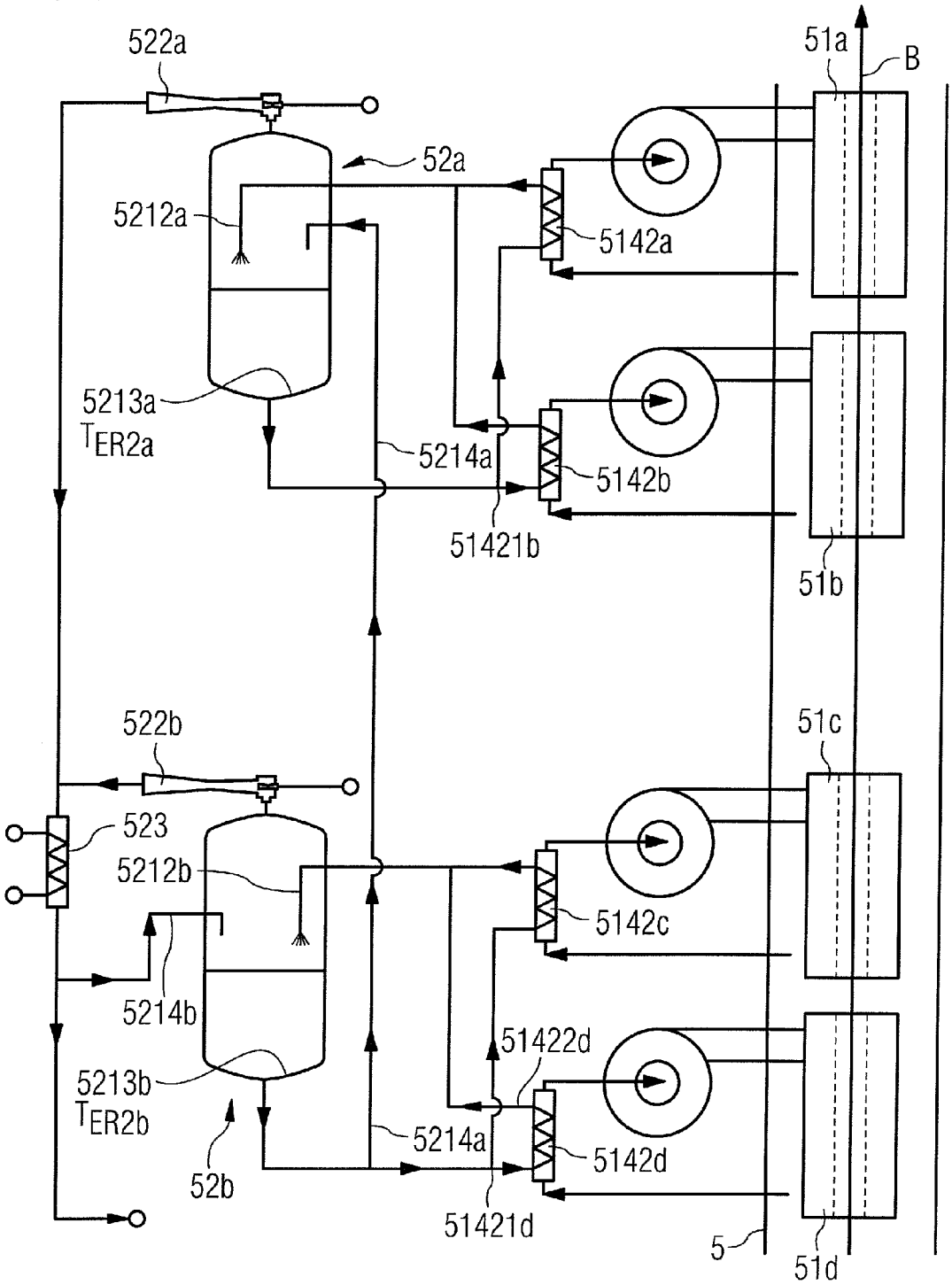
FIG. 5: Schematic diagram of the device according to the invention adapted to gradual cooling of the strip by blowing.

FIG. 5 describes the schematic diagram of the device according to the invention adapted to a gradual cooling method (as in FIG. 2*a*), for example by gas jet implementing four blowing cells (51*a*, 51*b*, 51*c*, 51*d*) each having one of four allocated exchangers (or exchange unit) (5142*a*, 5142*b*, 5142*c*, 5142*d*) successively positioned in the opposite direction to that in which the strip (B) is running and two cooling units (52*a*, 52*b*) with a sealed enclosure for each. The cells (51) are mounted in parallel two by two, the first two cells (51*a*, 51*b*) connected to the first cooling unit (52*a*) and the second two cells (51*c*, 51*d*) connected to the second cooling unit (52*b*). The water cooled by the second cooling unit (52*b*) is discharged at its outlet (5213*b*) at a first sealed enclosure outlet temperature ($T_{ER2b}$) for the part in the set of the first two (in the direction in which the strip is running) exchangers (5142*c*, 5142*d*) through the duct (51421*d*) and for the part in the first cooling unit (52*a*) through a supplementary duct (5214*a*). The water cooled by the first cooling unit (52*a*) is then discharged at its outlet (5213*a*) at a second outlet temperature ($T_{ER2a}$) lower than the first outlet temperature ($T_{ER2b}$) in the set of the last two (in the direction in which the strip is running) exchangers (5142*a*, 5142*b*) through a duct (51421*b*). On this figure, the required pump and valve accessories are not shown for reasons of clarity.

To sum up, it is thus possible to produce a device with a high cooling dynamic, such that at least one cooling unit (52*a*, 52*b*) is coupled to several heat exchange units (51*a*, 51*b*, 51*c*, 51*d*) distributed in the direction in which the strip is running (B).

Each exchange unit or group of exchange units (5142*a*, 5142*b*) mounted in parallel can thus be advantageously fitted with at least two cooling units mounted in series.

Figure 6:
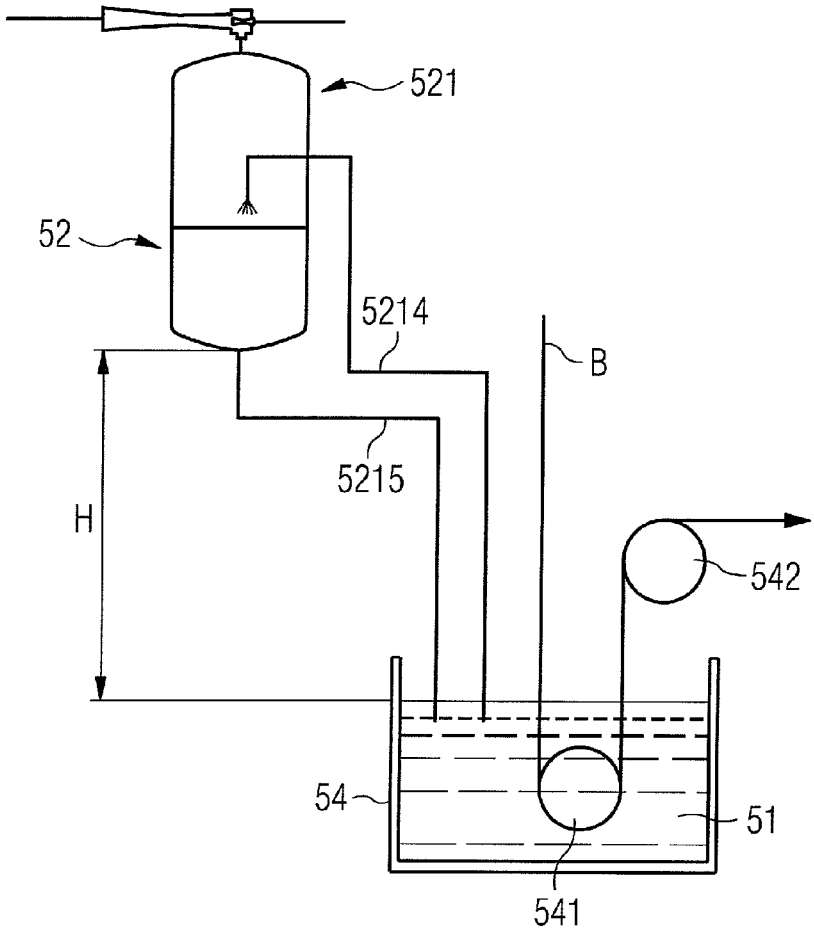
FIG. 6: Schematic diagram of the device according to the invention adapted to cooling by immersion in a tank.

FIG. 6 describes the schematic diagram of the device according to the invention adapted to strip cooling by immersion in a quenching tank. The strip (B) is plunged into a tank of cooling water (54) by winding onto two guide rollers (541, 542). The cooling unit (52) according to the invention is connected to the tank (54) by two ducts (5214, 5215) with a height (H) above the level of the water contained in the tank, thus constituting a water column of at least once atmospheric pressure and allowing for the circulation of water without pumps of the "barometric" type.

According to this embodiment, the exchange unit (51) between the steel strip (B) and the cooling water is thus for example a single direct-quenching cooling tank containing water maintained at a temperature of 30 to 50° C., which ensures instantaneous cooling of the strip by immersion. This situation exists in the quenching tank when maintenance of the annealing temperature ends and before overaging in the continuous annealing furnaces and also in the final cooling tanks at the outlet from the furnace on continuous annealing lines or final cooling at the outlet from the zinc pot on galvanization lines.

In a variant of this embodiment, the water in the final quenching tank in a continuous annealing or galvanization plant is maintained at a temperature between 5 and 10° C. and ensures cooling of the strip known as "in icy water".

In all cases of this embodiment, placing under partial vacuum allows, among other things, for degassing of the water in the tanks and elimination of dissolved oxygen, which considerably reduces the oxidation of the hot strip.

Between the sealed enclosure (521) and the exchange unit (51), there is a water circulation circuit comprising a closed circuit including, if necessary, for example for pumping up, at least one circulation pump.

Figure 7A:
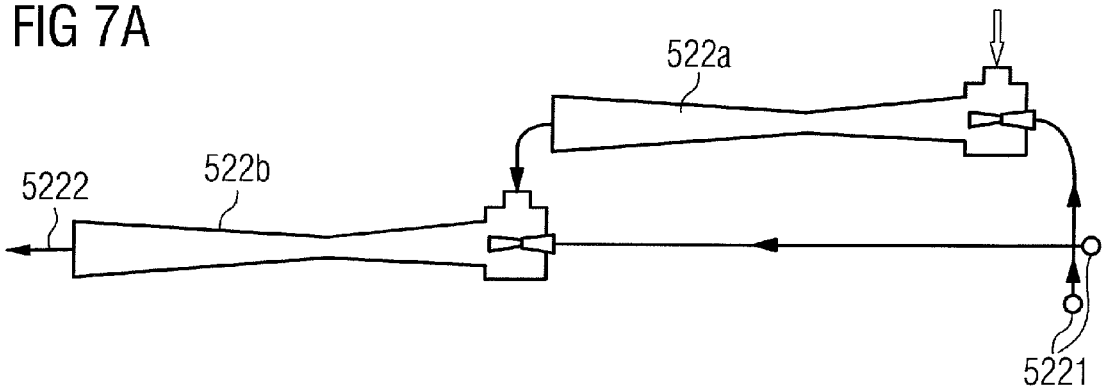
FIGS. 7*a*, 7*b*: Series connection of devices according to the invention.
Figure 7B:
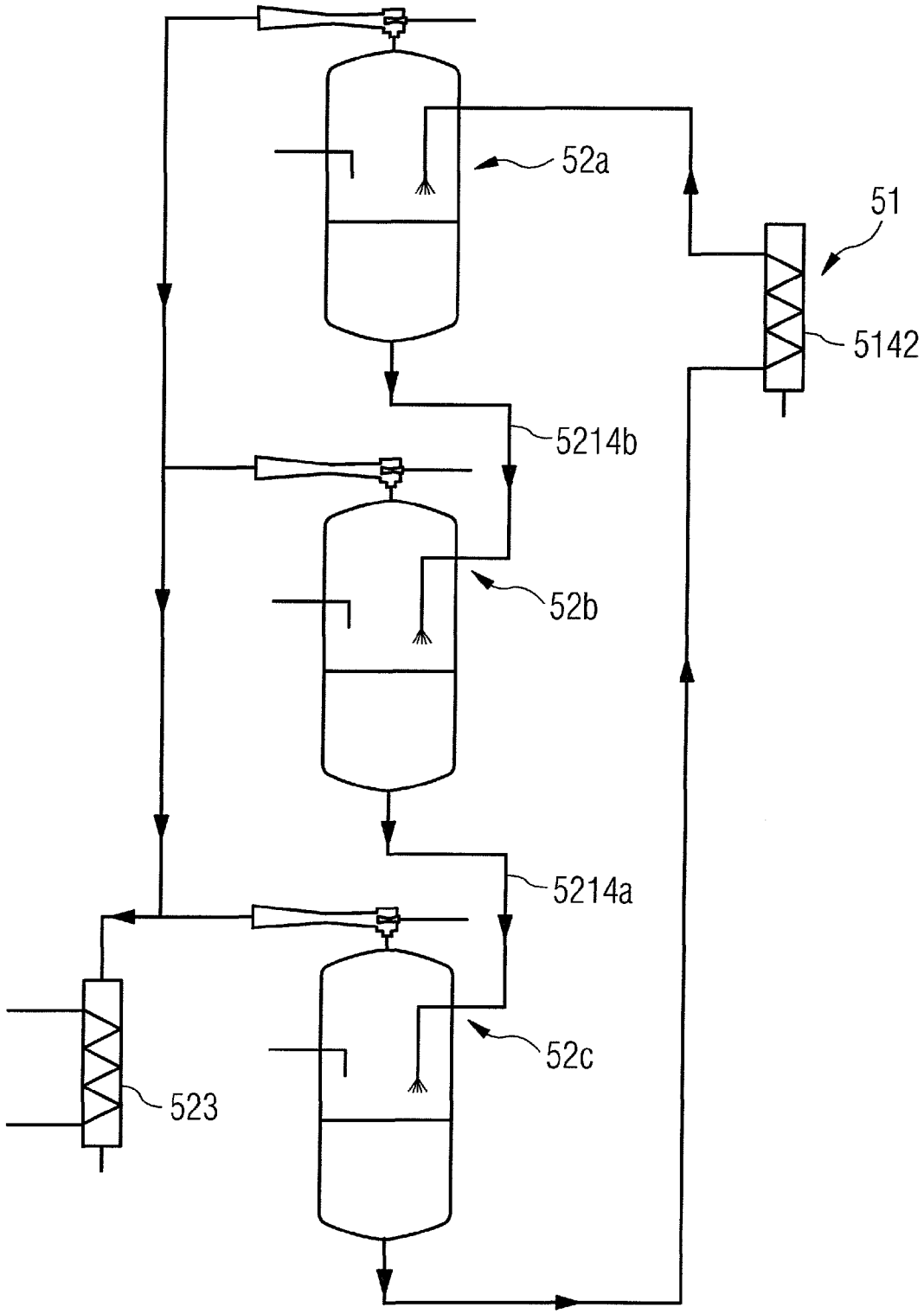

FIGS. 7*a*, 7*b* illustrate means for arranging devices according to the invention or certain elements of them in series in order to provide for more efficient/dynamic cooling adjustment.

FIG. 7*a* describes the series connection of two ejectors capable of being fitted to a sealed cooling enclosure like that described on the basis of FIG. 3*a*, in that each cooling unit (52) is fitted with at least two ejectors (522*a*, 522*b*) mounted in series.

A vapor outlet from the first ejector (522*a*) is directly positioned at one of the inlets to the second ejector (522*b*), which can be connected to a condensation unit. The two ejectors are for example supplied in common with vapor by a boiler (5221). The two final and common inlets (5221) to the ejectors are connected to the partial vacuum outlet from the sealed enclosure.

FIG. 7*b* describes (on the basis of the preceding example according to FIG. 5) the series connection of three cooling units (52*a*, 52*b*, 52*c*) capable of providing for a great reduction in the temperature of the cooling water in three successive stages for a single exchange unit (51, 5142), on the side of the strip to be cooled. Ducts (514*a*, 5214*b*) successively connect a "water" enclosure outlet to an adjacent supplementary "water" inlet. Partial vacuums are thus formed in the enclosures, wherein each of the outlets from their ejectors can be connected to a common condensation unit (523).

To sum up, several cooling units (52*a*, 52*b*, 52*c*) can be coupled to an exchange unit (51) with a view advantageously to staging a reduction in the temperature of the cooling water.

At least one of these cooling units (52*a*, 52*b*, 52*c*) can also be fitted with at least two ejectors mounted in series.

The invention claimed is:

1. A method for adjusting cooling needed for a forced cooling of a steel strip running continuously in a plant adapted for continuous annealing or continuous hot-dip galvanization, cooling energy is given up to heated water by the steel strip and then removed by evaporation of the heated water at a pressure below atmospheric pressure and finally returned by condensation at a higher temperature following thermomechanical compression by a venturi device supplied with vapor at a pressure higher than atmospheric pressure, which comprises the steps of:

collecting the heated water heated by the steel strip in an exchange unit at a first pressure close to the atmospheric pressure and a first temperature lower than an evaporation temperature of the heated water at the first pressure;

introducing the heated water from the exchange unit in a form of a jet into a sealed enclosure of a cooling unit fitted with at least one ejector being a venturi device, the ejector also being supplied with water vapor at an incoming pressure higher than the atmospheric pressure, the ejector providing a partial vacuum in the sealed enclosure corresponding to a second pressure lower than the evaporation pressure of the water at the first temperature; and recovering cooled water at an outlet of the sealed enclosure at a second temperature corresponding to the evaporation temperature of the water at the second pressure to be returned to the exchange unit.

2. The method according to claim 1, which further comprises using an additional cooling circuit at an outlet of the ejector; and obtaining a vapor emerging from the ejector and with a thermal energy associated with a decreasing kinetic energy and increased by a fraction of heat originating from cooling water obtained by evaporation, at an output pressure from the ejector being higher than the atmospheric pressure, the vapor emerging from the ejector at an output temperature corresponding to an evaporation pressure for the water at the output pressure and supplies a condensation unit from which it emerges again at a post-condensation temperature lower than the output temperature from the ejector and under an evaporation pressure for the water at a pressure adjacent to the atmospheric pressure, the condensation unit provides, through a wall, for the heating of an external water circuit at an external input pressure from an external input temperature lower than an evaporation output temperature at the external input pressure to the external output temperature corresponding to the evaporation temperature for the water at an external output pressure.

3. The method according to claim 1, which further comprises:

using an additional cooling circuit at the outlet of the ejector; and obtaining a vapor emerging from the ejector and with a thermal energy associated with a decreasing kinetic energy and increased by a fraction of heat originating from cooling water obtained by evaporation, at an output pressure higher than the atmospheric pressure, the vapor emerging from the ejector at an output temperature corresponding to an evaporation pressure for the water at the output pressure and is brought into direct contact in a direct-contact (thermal) water exchanger, the water being at an external input pressure from an external input temperature lower than an output temperature to the output temperature of a mixture of two vapor-water fluids capable of reaching the evaporation temperature of the water at the external input pressure.

4. The method according to claim 1, which further comprises reintroducing the water emerging from the condensation unit at the post-condensation temperature as a supplement into the sealed enclosure through a duct; and redirecting a surplus of the water, if any, towards an external pipe for vapor reuse or dissipation.

5. The method according to claim 1, wherein at an outlet from the cooling unit, the cooled water recovered at the outlet from the sealed enclosure is water known as icy at the second temperature between 5 and 10° C.

6. A cooling adjustment device for forced cooling of a steel strip running continuously in a plant adapted for continuous annealing or continuous hot-dip galvanization, the cooling adjustment device comprising:

at least one exchange unit providing for a transfer of heat from the steel strip to cooling water and having an outlet for the cooling water thus heated and an inlet;

at least one cooling unit having a sealed enclosure connected to said outlet of said exchange unit and at least one outlet, said sealed enclosure having an auxiliary outlet connected to said inlet of said exchange unit; and a Venturi effect device being a vapor ejector and having an outlet and an inlet, said inlet of said vapor ejector connected to said at least one outlet of said cooling unit, and in said vapor ejector the cooling water is subjected to cooling by evaporation in a vacuum.

7. The device according to claim 6, further comprising:

an external pipe; and at least one vapor condensation unit disposed at said outlet of said vapor ejector and adapted for re-supplying said sealed enclosure by an addition of a required level of water in and, adapted for redirecting a surplus of vaporized water towards said external pipe for vapor reuse or dissipation.

8. The device according to claim 6, further comprising a vapor production boiler heated with flue gas in a direct-flame heating part of a furnace or by radiant tube section fumes; and wherein said vapor ejector has an auxiliary inlet through which said vapor ejector is supplied by at least part to all of a required vapor by means of said vapor production boiler.

9. The device according to claim 6, wherein said cooling unit is one of several cooling units coupled to said exchange unit with a view to staging a reduction in a temperature of the cooling water.

10. The device according to claim 6, wherein:

said heat exchange unit is one of several heat exchange units disposed in a direction in which the steel strip is running; and said at least one cooling unit is coupled with said several heat exchange units.

11. The device according to claim 7, wherein part to all of the water emerging from said vapor condensation unit can be re-injected, following possible re-cooling, into a circuit of demineralized water which can be used by the plant for continuous annealing or continuous hot-dip galvanization.

12. The device according to claim 7, wherein said vapor condensation unit actuating said vapor ejector is a wall exchanger.

13. The device according to claim 7, wherein said vapor condensation unit activating said vapor ejector is a direct-contact exchanger.

14. The device according to claim 10, wherein:

said cooling unit is one of a plurality of cooling units; and each of said exchange units or group of said exchange units are installed in parallel and fitted with at least two of said cooling units installed in series.

15. The device according to claim 6, wherein said vapor ejector is one of at least two vapor ejectors and said cooling unit is fitted with said at least two ejectors installed in series.

16. The device according to claim 6, wherein said exchange unit between the steel strip and the cooling water is a gas/water exchanger.

17. The device according to claim 1, wherein:

said cooling unit is one of two cooling units;

said vapor ejector is one of a plurality of vapor ejectors; and said exchange unit has at least two heat exchangers disposed in series on a heat exchange path between the steel strip and the cooling water, each of said at least two heat exchangers being connected to one of said two cooling units, and two of said vapor ejectors for said cooling units being coupled in parallel.

18. The device according to claim 17, wherein:

said exchange unit has air ducts, a blowing box and at least one fan supplying, through said air ducts, said blowing box through which the steel strip passes and which is supplied by an air duct collecting a hot air in said blowing box; and each of said air ducts coupled to one of said two heat exchangers.

19. The device according to claim 6, further comprising a water circulation circuit disposed between said sealed enclosure and said exchange unit, said water circulation circuit having a collection pipe and a return pipe constituting a water column at least 11 meters high.

20. The device according to claim 6, wherein said exchange unit between the steel strip and the cooling water is a direct-tempering cooling tank.

21. The device according to claim 6, further comprising a water circulation circuit disposed between said sealed enclosure and said exchange unit, said water circulation circuit having a closed circuit having at least one circulation pump.

* * * * *